US009752382B2

(12) United States Patent
Lueker

(10) Patent No.: US 9,752,382 B2
(45) Date of Patent: Sep. 5, 2017

(54) ASSEMBLY FOR INSULATING A DOOR CURTAIN

(71) Applicant: CORNELL IRONWORKS ENTERPRISES, Mountaintop, PA (US)

(72) Inventor: David Lueker, Glendale, AZ (US)

(73) Assignee: CORNELL IRONWORKS ENTERPRISES, Mountaintop, PA (US)

( * ) Notice: Subject to any disclaimer, the term of this patent is extended or adjusted under 35 U.S.C. 154(b) by 0 days.

(21) Appl. No.: 14/988,439

(22) Filed: Jan. 5, 2016

(65) Prior Publication Data

US 2016/0123077 A1 May 5, 2016

Related U.S. Application Data

(60) Continuation of application No. 14/101,549, filed on Dec. 10, 2013, now abandoned, which is a division of (Continued)

(51) Int. Cl.
*E06B 9/42* (2006.01)
*E06B 9/174* (2006.01)

(Continued)

(52) U.S. Cl.
CPC ..... *E06B 9/42* (2013.01); *E06B 9/174* (2013.01); *E06B 9/58* (2013.01); *E06B 9/13* (2013.01); *E06B 2009/588* (2013.01)

(58) Field of Classification Search
CPC ..... E06B 9/42

(Continued)

(56) References Cited

U.S. PATENT DOCUMENTS 1,526,346 A 2/1925 Kivikink
1,741,609 A 12/1929 Brooks (Continued)

FOREIGN PATENT DOCUMENTS

FR 2607173 11/1986
FR 2607173 A1 * 5/1988
WO 2005111364 11/2005

OTHER PUBLICATIONS

Advisory Action dated Feb. 1, 2016 for U.S. Appl. No. 14/101,549.

(Continued)

*Primary Examiner* — Blair M Johnson
(74) *Attorney, Agent, or Firm* — Snell & Wilmer L.L.P.

(57) ABSTRACT

The present disclosure includes a system and article of manufacture for a door assembly for rolling and unrolling, or retracting and extending, a door curtain. The door assembly may include various mechanisms to protect a door curtain from wear and abrasion, as well as muffle noise associated with the operation of the door curtain. The door assembly may comprise a curtain shaft. A door curtain may roll and/or unroll (e.g., open and/or close) on the curtain shaft. The door assembly may further include an insulator shaft, which may receive or hold a door curtain insulator or insulators. A door curtain insulator may attach to the insulator shaft as well as the curtain shaft and/or door curtain itself. In operation, as the door curtain is rolled up, one or more lengths of insulator may be unrolled from the insulator shaft and layered, or interleaved, between consecutive layers of rolled up door curtain. Similarly, as the door curtain is unrolled, one or more lengths of insulator may be rolled up or wound about the insulator shaft, such that no insulator travels with the curtain as it unrolls towards a closed position. The door assembly may also include a mechanism for compensating for a difference between an angular speed (Continued)

of a door curtain on a curtain shaft and an angular speed of a door curtain insulator on an insulator shaft.

15 Claims, 6 Drawing Sheets

Related U.S. Application Data application No. 13/213,868, filed on Aug. 19, 2011, now abandoned.

(51) Int. Cl.
*E06B 9/58* (2006.01)
*E06B 9/13* (2006.01)

(58) Field of Classification Search
USPC ..... 160/310, 133, 23.1, 120, 313, 311, 160/370.22
See application file for complete search history.

(56) References Cited

U.S. PATENT DOCUMENTS

| | | | | |
|---|---|---|---|---|
| 1,828,623 | A | | 10/1931 | Sacerdote |
| 2,361,762 | A | | 10/1944 | Glenn et al. |
| 2,934,139 | A | | 4/1960 | Wardlaw et al. |
| 3,019,450 | A | * | 2/1962 | Karasiewicz ..... E04H 4/101 160/133 |
| 3,451,463 | A | | 6/1969 | Lyman |
| 4,237,956 | A | | 12/1980 | Sivin et al. |
| 4,565,231 | A | | 1/1986 | Moessner et al. |
| 4,887,660 | A | | 12/1989 | Kraus |
| 4,976,302 | A | | 12/1990 | Taylor |
| 5,381,846 | A | | 1/1995 | Lichy |
| 5,632,317 | A | | 5/1997 | Krupke et al. |
| 8,393,380 | B2 | | 3/2013 | Uehara et al. |
| 8,418,280 | B2 | | 4/2013 | Schwerzmann |
| 2011/0277945 | A1 | | 11/2011 | Schwerzmann et al. |
| 2013/0042981 | A1 | | 2/2013 | Lueker |

OTHER PUBLICATIONS

Restricted Office Action dated Sep. 6, 2013 for U.S. Appl. No. 13/213,868.
Non-Final Office Action dated Nov. 15, 2013 for U.S. Appl. No. 13/213,868.
Final Office Action dated Apr. 4, 2014 for U.S. Appl. No. 13/213,868.
Advisory Action dated Jun. 11, 2014 for U.S. Appl. No. 13/213,868.
Non-Final Office Action dated Jul. 3, 2014 for U.S. Appl. No. 13/213,868.
Non-Final Office Action dated Dec. 19, 2014 for U.S. Appl. No. 14/101,549.
Final Office Action dated Aug. 5, 2015 for U.S. Appl. No. 14/101,549.
Examiner Interview dated Nov. 2, 2015 for U.S. Appl. No. 14/101,549.
Examiner Interview dated Nov. 24, 2015 for U.S. Appl. No. 14/101,549.

* cited by examiner

ASSEMBLY FOR INSULATING A DOOR CURTAIN

CROSS-REFERENCE TO RELATED APPLICATION

This application claims priority to and is a continuation of U.S. patent application Ser. No. 14/101,549, entitled "ASSEMBLY FOR INSULATING A DOOR CURTAIN," filed on Dec. 10, 2013. The '549 application is a divisional of and claims the benefit of and priority to U.S. patent application Ser. No. 13/213,868, entitled "ASSEMBLY FOR INSULATING A DOOR CURTAIN," filed on Aug. 19, 2011. All the aforementioned applications are hereby incorporated by reference in their entirety.

BACKGROUND

Field

The present disclosure generally relates to doors. More particularly, the present disclosure relates to door curtains and other retractable or "rollup" doors.

Related Art

Rollup, or rolling, doors are widely used for industrial and commercial purposes. For example, rollup doors are commonly used as cargo bay doors, self storage unit doors, garage doors, and the like. Rollup doors often comprise a number of interconnected leaves or slats, and this group of interconnected slats may comprise a "door curtain" or "curtain." The curtain may be mounted to an overhead shaft, and as the rollup door is opened, or rolled up, the curtain may wind in layers about the shaft. Very often, the slats are metallic, and as the curtain is rolled up or unrolled, the slats produce considerable friction and noise as they come into contact.

Attempts have been made to lessen the wear experienced by rollup doors. Attempts have also been made to lessen the noise produced by these doors as they are opened and closed. For instance, some manufacturers have attempted to place a cushioning or insular material between consecutive layers of rolled up door curtain. Although these attempts have perhaps succeeded in insulating a variety of door curtains from wear, they have suffered from the disadvantage that the insulating material has been visible and/or accessible when the door to which it is secured is closed. Accessible and/or visible insulating material may pose a safety risk and may be regarded as detracting from the aesthetic simplicity of the curtain itself.

A rollup door comprising a non-visible or hidden insulating material would, therefore, comprise an advantageous improvement. That is, a rollup door fitted with an insulating material that retracts or rolls up when the door is rolled down or closed would comprise a significant advantage over the prior art. Indeed, such a door would protect the door from wear and insulate against the operational noise produced by the door, but preserve the aesthetic appeal of the uninsulated door and improve the safety of the door by removing the insulating material (in which, for example, a person may become entangled) from reach. Additionally, such a door may benefit the environment, in that a longer door lifetime, and subsequently less landfill, may result from the improved lifetime of the door. The quiet operation of the door may be of further advantage to the preservation of the natural environment.

SUMMARY

The present disclosure includes a system and article of manufacture for a door assembly for rolling and unrolling, or retracting and extending, a door curtain. The door assembly may include various mechanisms to protect a door curtain from wear and abrasion, as well as muffle noise associated with the operation of the door curtain.

The door assembly may comprise a curtain shaft. A door curtain may roll and/or unroll (e.g., open and/or close) on the curtain shaft. The door assembly may further include an insulator shaft, which may receive or hold a door curtain insulator or insulators, such as one or more lengths of seat belt. A door curtain insulator may attach to the insulator shaft as well as the curtain shaft and/or door curtain itself. In operation, as the door curtain is rolled up, one or more lengths of insulator may be unrolled from the insulator shaft and layered, or interleaved, between consecutive layers of rolled up door curtain. Similarly, as the door curtain is unrolled, one or more lengths of insulator may be rolled up or wound about the insulator shaft, such that no insulator travels with the curtain as it unrolls towards a closed position.

The door assembly may further comprise a mechanism for compensating for a difference between an angular speed of a door curtain hung on a curtain shaft and an angular speed of a door curtain insulator hung on an insulator shaft. To this end, the invention described herein may include a curtain shaft and an insulator shaft that are elastically coupled by a recoil assembly. The recoil assembly may comprise, in part, a spring, and may compensate for the difference between the angular speed of the door curtain and door curtain insulator by tensioning and/or releasing the tension in the spring. In this regard, the recoil assembly may compensate for the difference between the angular speed of the door curtain and door curtain insulator by tensioning as a door curtain is raised and releasing tension as the door curtain is lowered. The released tension may impart an angular speed to the insulator shaft. In an embodiment, the recoil assembly (e.g., the spring) may be non-rigidly or non-fixedly mounted between the curtain shaft and the insulator shaft. For example, the spring may non-fixedly engage a hub assembly at a first overbend and non-fixedly engage a sprocket assembly at a second overbend. A non-rigid mounting may enhance the lifetime of the recoil assembly and/or spring.

BRIEF DESCRIPTION OF THE DRAWINGS

The features and advantages of the present disclosure will become more apparent from the detailed description set forth below when taken in conjunction with the drawings. The left-most digit of a reference number identifies the drawing in which the reference number first appears.

DETAILED DESCRIPTION

Figures 1A, 1B:
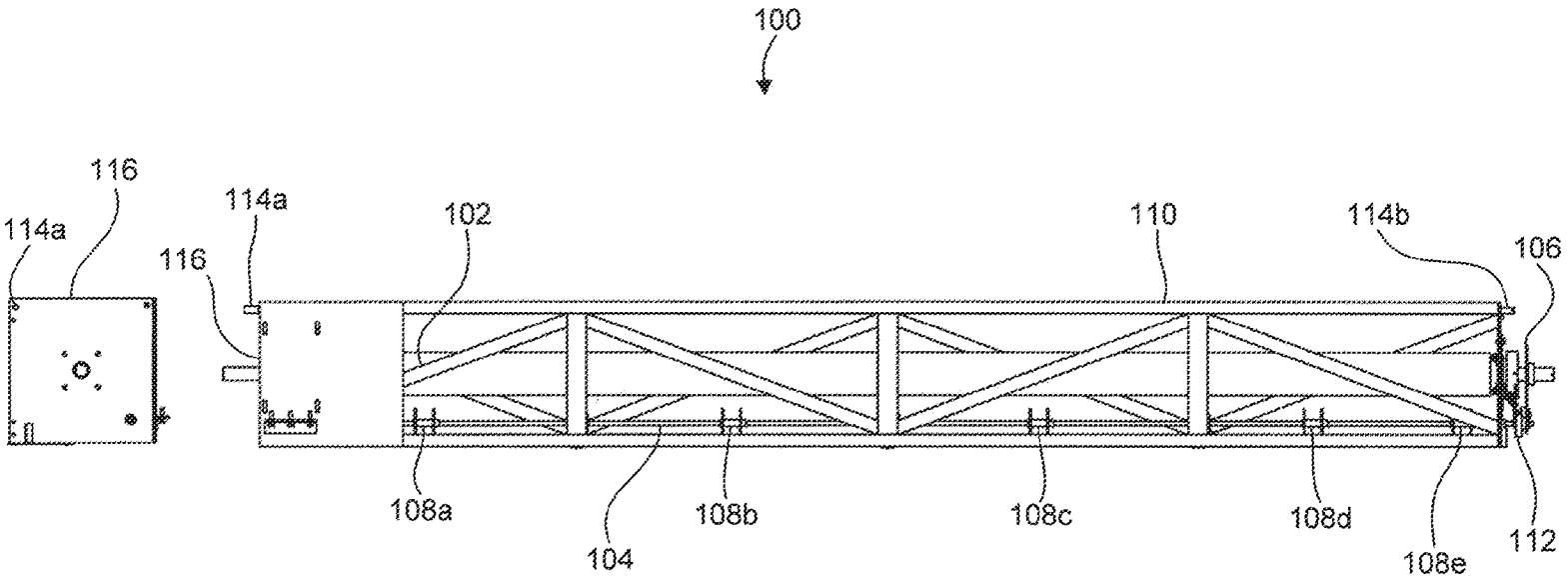
FIG. 1A shows a perspective view of an exemplary door assembly.
FIG. 1B shows a perspective view of an exemplary bracket of a door assembly.

The detailed description of exemplary embodiments herein makes reference to the accompanying drawings, which show the exemplary embodiments by way of illustration and their best mode. While these exemplary embodiments are described in sufficient detail to enable those skilled in the art to practice the disclosure, it should be understood that other embodiments may be realized and that logical and mechanical changes may be made without departing from the spirit and scope of the disclosure. Thus, the detailed description herein is presented for purposes of illustration only and not of limitation. For example, the steps recited in any of the method or process descriptions may be executed in any order and are not limited to the order presented. Furthermore, any reference to singular includes plural embodiments, and any reference to more than one component may include a singular embodiment.

While the specific embodiments of the present invention will be described in greater detail below, in general, an embodiment of the present invention comprises a door assembly for rolling and unrolling, or retracting and extending, a door curtain. The door assembly may operate to protect a door curtain from wear and abrasion as well as muffle any noise associated with the operation of the door curtain. To this end, the door assembly may comprise a curtain shaft. A door curtain may roll and/or unroll (e.g., open and/or close) on the curtain shaft.

The door assembly may further include an insulator shaft, which may receive or hold a door curtain insulator or insulators, such as one or more lengths of strap or belt material (e.g., vehicle seat belt material). A door curtain insulator may attach to the insulator shaft (e.g., at a first end) as well as the curtain shaft and/or door curtain itself (e.g., at a second end). In operation, as the door curtain is rolled up, one or more lengths of insulator may be unrolled from the insulator shaft and layered, or interleaved, between consecutive layers of rolled up door curtain. Similarly, as the door curtain is unrolled, one or more lengths of insulator may be rolled up or wound about the insulator shaft, such that no insulator travels with the curtain as it unrolls towards a closed position.

Thus, a door curtain may be insulated from wear resulting from the rubbing or abrasion of each layer of rolled curtain against each neighboring layer and the noise resulting from the operation of the curtain as it moves between open and closed positions may be muffled. Moreover, because the one or more insulators may be rolled about the insulator shaft as the curtain descends, the door assembly may confer these advantages in a safe and aesthetically pleasing way (i.e., because the insulators are not conspicuously visible, nor are they easily accessible, when the curtain is in a closed or unrolled position).

As a result of the operation described above, the circumference of the insulator on the insulator shaft increases as the circumference of the curtain on the curtain shaft decreases and vice versa. Thus, relative to the curtain shaft, the angular speed at which the insulator on the insulator shaft rolls or unrolls may decrease or increase as door curtain is rolled and unrolled from the curtain shaft.

For instance, for purposes of illustration only, assume that during operation, the curtain shaft turns at a substantially constant 1 revolution per minute (rpm). Then, if at a first time ($t_1$) the circumference of the curtain on the curtain shaft is about 75 inches, then curtain will be unrolled from the curtain shaft at a rate of about 75 inches per minute. As a brief aside, it should be noted that the actual amount of curtain unrolled in one minute will likely vary from the original circumference of 75 inches because the actual circumference changes continuously as the curtain is unrolled. However, for purposes of illustration of issues discussed herein, the examples are simplified to a rate at an "instantaneous" point in time as noted.

Similarly, if at a second time ($t_2$), the circumference of the curtain on the curtain shaft is about 37 inches, then the curtain will be unrolled from the curtain shaft at a rate of about 37 inches per minute. And, if at a third time (t3), the circumference of the curtain on the curtain shaft is about 20 inches, the curtain will be unrolled from the curtain shaft at a rate of about 20 inches per minute.

In contrast, with respect to the insulator shaft, if at time $t_1$, the circumference of the insulator on the insulator shaft is about 5 inches and the rate of uptake of insulator material onto the insulator shaft is about 75 inches per minute (because the door curtain is unrolling at 75 inches per minute), the insulator shaft rotates at 75/5 rpm, or approximately 15 rpm. Once again, as with the curtain shaft, it should be noted that the actual amount of insulator material rolled onto the insulator shaft in one minute will vary because the actual circumference changes continuously as the insulator materials is rolled onto it. Similarly, because the circumference of the insulator increases as more material is rolled onto it, the actual angular speed of insulator shaft will vary. However, again, for purposes of illustration of issues discussed herein, the examples are simplified to a rate at an instantaneous point in time as noted.

Similarly, if at time t2 the circumference of the insulator on the insulator shaft is about 7 inches and the rate of uptake of insulator material onto the insulator shaft is about 37 inches per minute, the insulator shaft rotates at about 37/7 rpm, or approximately 5.2 rpm. And, if at time t3 the circumference of the insulator on the insulator shaft is about 9 inches and the rate of uptake of insulator material onto the insulator shaft is about 20 inches per minute, the insulator shaft rotates at about 20/9 rpm, or approximately 2.2 rpm. This is depicted in a tabular format below.

Example 1

| Time | Curtain Shaft (rpm) | Insulator Shaft (rpm) |
|---|---|---|
| $t_1$ | 1 | 15 |
| $T_2$ | 1 | 5.2 |
| $T_3$ | 1 | 2.2 |

Thus, as the table in Example 1 shows, the insulator shaft may rotate at a rate that varies with the circumference of the curtain shaft and insulator shaft. Similarly, although not depicted, where the door curtain is rolled up about the curtain shaft (i.e., the door curtain is opened), the insulator shaft may rotate at a rate that increases as the circumference of the door curtain on the curtain shaft increases).

As a result of this relationship in angular speed between the curtain shaft and the insulator shaft, and in order to roll and unroll insulator at the same (or substantially the same) rate that curtain is unrolled and rolled, it is necessary that the insulator shaft is able to rotate at a rate that is different than the rate at which the curtain shaft rotates. To this end, the door assembly may comprise a recoil assembly. A recoil assembly, which may comprise, in an embodiment, a power spring or clock spring, elastically couples the curtain shaft to the insulator shaft. In operation, the recoil assembly continuously compensates for the differences in angular speed between the insulator shaft and curtain shaft. Thus, the recoil assembly permits the insulator shaft to dispense and withdraw, or roll and unroll, insulator at a rate that matches, or substantially matches, the rate at which the curtain shaft dispenses and withdraws door curtain.

Figure 2:
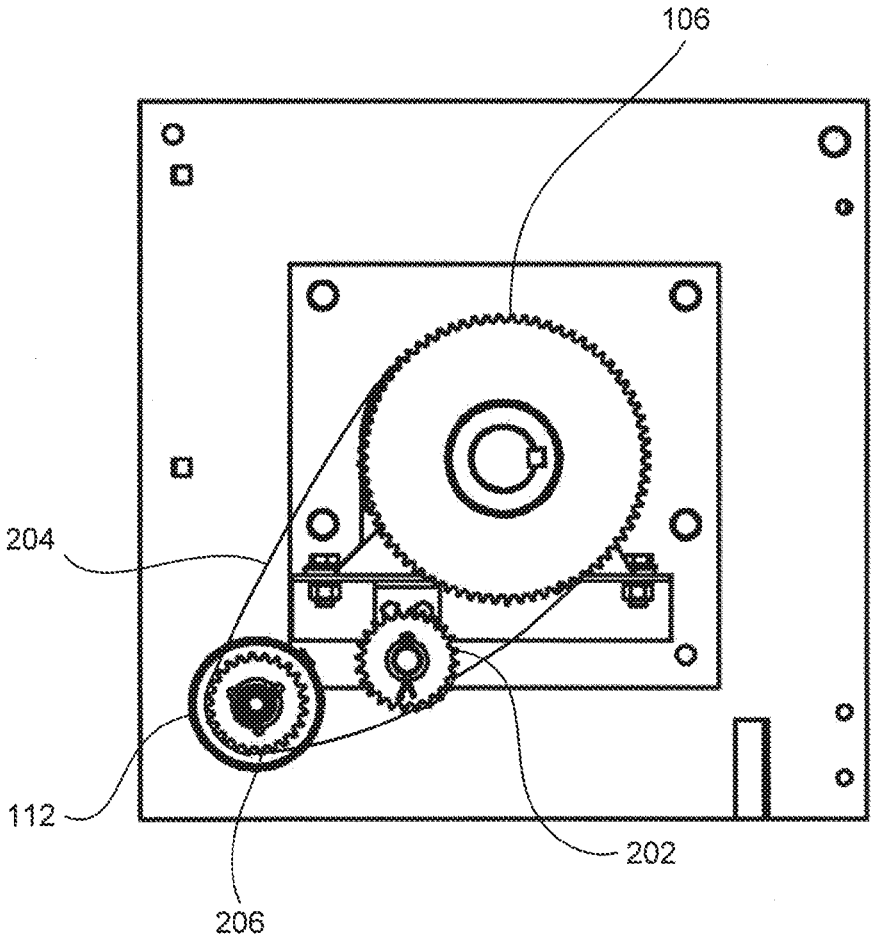
FIG. 2 shows a perspective view of an exemplary door assembly, in which a recoil assembly is mechanically coupled to a drive sprocket.

With reference now FIGS. 1A, 1B, and 2, perspective views of an exemplary door assembly 100 are depicted. A door assembly 100 may comprise a curtain shaft 102, an insulator shaft 104, a drive sprocket 106, a drive mechanism, one or more strap guide assemblies 108*a*, 108*b*, 108*c*, 108*d*, 108*e*, a truss cage 110, a recoil assembly 112, one or more locating pins 114*a* and 114*b*, a bracket 116, an idler arm assembly 202, a chain or drive coupling 204, and a recoil assembly sprocket 206.

A truss cage 110 and various panels or covers may protect or shield a door assembly 100 from damage and/or debris, and likewise make the door assembly 100 more aesthetically pleasing overall. In an embodiment, a truss cage 110 may comprise a unitized structure. For example, truss cage 110 may comprise a prefabricated or preassembled structure, which may facilitate installation of the truss cage 110 and/or alignment and installation of one or more components (e.g., curtain shaft 102 and/or insulator shaft 104) within the truss cage 110.

Figure 5:
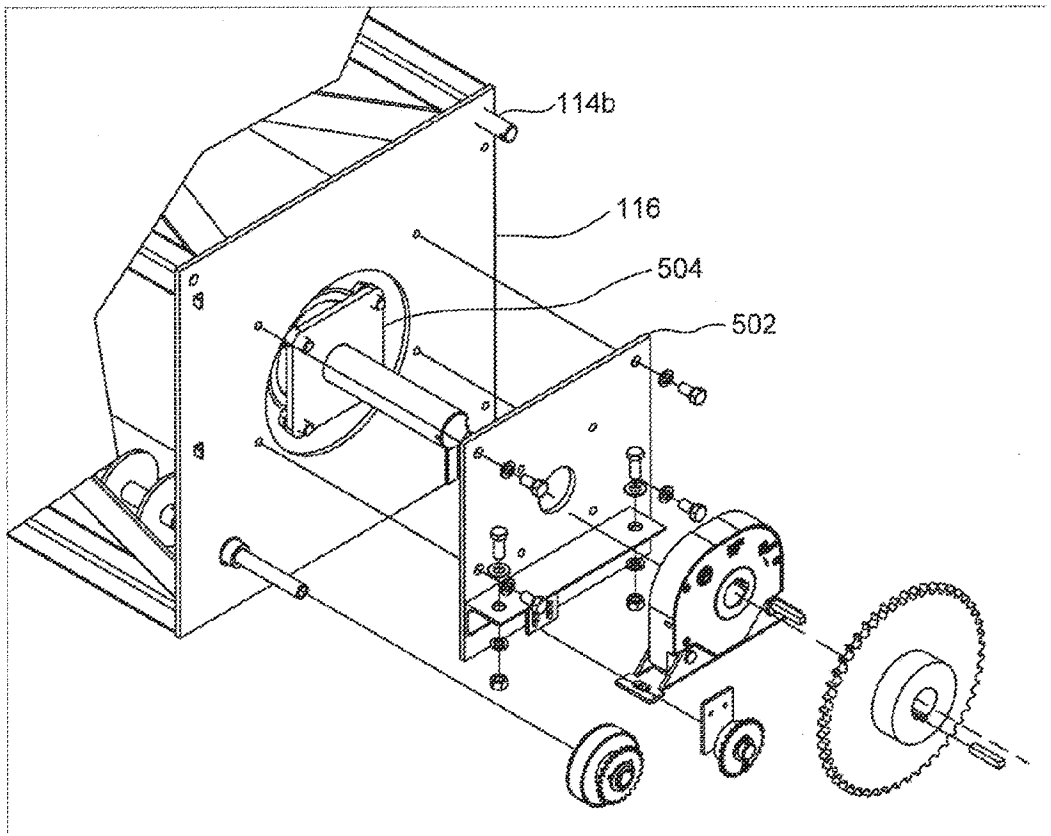
FIG. 5 shows a perspective view of a bracket and hatch.

In an exemplary embodiment, and with reference to FIG. 5, a truss cage 110 may further comprise a hatch 502, which may be opened to permit removal of and/or access to one or more components comprising door assembly 100 (e.g., a curtain shaft 102 and/or an insulator shaft 104). For example, in an embodiment, a hatch 502 may be attached to bracket 116, and an individual may open the hatch 502 in order to more easily remove and/or access one or both of curtain shaft 102 and insulator shaft 104. An individual may wish to remove and/or gain access to a curtain shaft 102 and/or an insulator shaft 104, for example, in order to replace and/or maintain one or more bearings coupled to the one or more shafts 102 and 104.

Figure 6:
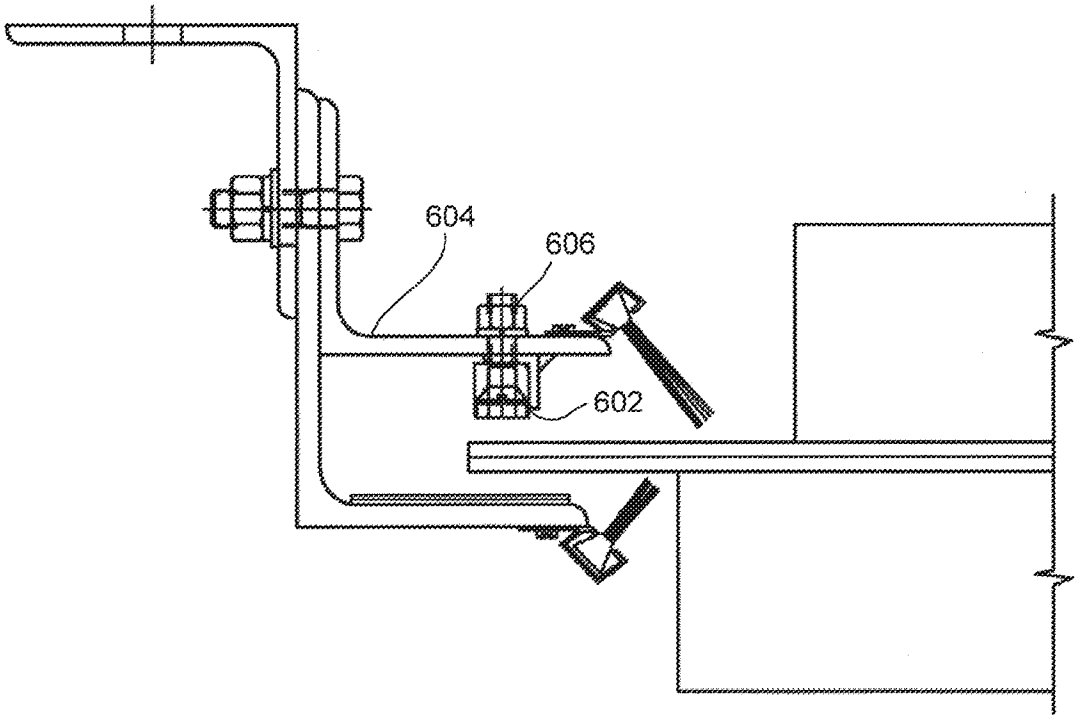
FIG. 6 shows a perspective view of a wind lock bar.

Further still, in an exemplary embodiment and with reference to FIG. 6, the invention may comprise a wind lock bar 602 and/or one or more wind locks. For example, the invention may comprise a wind lock bar 602 that spans all or a portion of one or more of the vertical edges of a door frame and couples, in an embodiment, to an inner angle 604. A wind lock bar 602 may couple to a door frame and/or an inner angle 604 by way of a locking bolt 606, any type of tape (e.g., a foam tape), and/or any type of adhesive (e.g., a spray on adhesive). In an embodiment, it may be advantageous to use a combination of tape and adhesive, as this may achieve a stronger and more resilient bond between a wind lock bar 602 and a door frame and/or inner angle 606. For example, a foam tape may be used in combination with a spray on adhesive to achieve a strong bond that also helps to muffle the noise produced by the door curtain as it moves within or against the wind lock bar.

A door curtain may comprise one or more wind locks, which may mechanically engage with a wind lock bar 602 to retard or calm the motion of a door curtain in the wind. A wind lock bar 602 may comprise any material (e.g., a metal material, a plastic material, a synthetic material, a natural material, and the like). However, in an embodiment, a wind lock bar 602 and/or one or more wind locks may comprise an ultra high molecular weight polyethylene material, or UHMWPE/UHMW material. A UHMW material may enhance door life as well as muffle noise produced by a door as it travels between opened and closed positions. A UHMW wind lock bar may additionally function as a wear strip. That is, a UHMW wind lock bar may reduce or withstand wear occurring as a result of the motion of a door frame within or against a wind lock bar.

Figure 4:
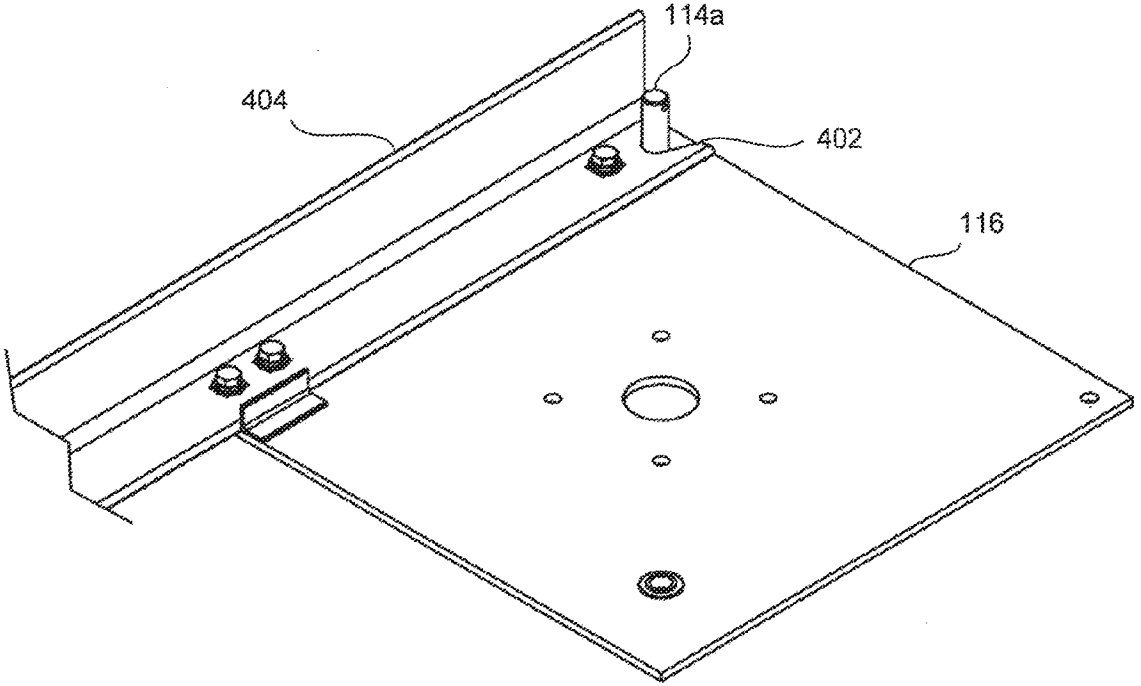
FIG. 4 shows a perspective view of a bracket configured for installation of a door assembly.

With regard to installation, in an exemplary embodiment, one or more locating pins 114*a* and/or 114*b* may aid in the installation of a door assembly 100. More particularly, and with reference now to FIG. 4, a door assembly 100 may be installed over and/or coupled to a door frame by way of one or more guide slots 402. That is, a door assembly 100 may be lowered into place between one or more guides 404, which may define a perimeter of a door frame. As a door assembly is lowered, locating pins 114*a* and/or 114*b* may be set or lowered into one or more guide slots 402 in guides 404. That is, in an embodiment, guide pin 114*a* may fit into a first guide slot 402, while guide pin 114*b* may fit into a second guide slot. Thus, installation of a door assembly 100 may be facilitated by way of one or more guide slots 402 and/or one or more locating pints 114*a* and/or 114*b*. Guide pins 114*a* and/or 114*b* may further include one or more anti-rotation tabs, which may restrict or prevent a motion of door assembly 100 as it is lowered into one or more guides 404 and/or after it has been brought to rest in one or more guides 404.

As discussed more briefly above, a door assembly 100 may protect a door curtain from wear and abrasion as well as muffle any noise associated with the operation of the door curtain by preventing contact of the door curtain upon itself as it is rolled or unrolled and/or by providing sound dampening. That is, door assembly 100 may interleave or layer one or more insulators (e.g., lengths of seat belt) between layers of rolled up door curtain. This interleaving of insulators between rolled up layers of door curtain may protect the door curtain from wear and abrasion, as well as muffle noise produced by the interaction of each layer of door curtain against the next.

Any suitable number of insulators may be used, but in various embodiments, two, three, four, five, and six insulators may be used. The number of insulators may depend upon the size of a particular door curtain (e.g., larger or heavier door curtains may require greater insulation). Further, in an embodiment, an insulator may comprise materials such as an automotive seat belt webbing material having various suitable thicknesses and widths. For example, an insulator may comprise automotive seat belt webbing having a thickness of about 50/1000 of an inch and a width of about two inches.

Further, as discussed above, door assembly 100 may achieve these advantages in a safe and aesthetically pleasing manner. For example, insulator shaft 104 may receive and dispense insulator as a door curtain opens and closes from curtain shaft 102. That is, as a door curtain is raised, insulator shaft 104 may dispense insulator, which may, in turn, be interleaved or layered between consecutively layered rolls of door curtain. Likewise, as a door curtain descends into a closed position, insulator shaft 104 may rotate such that insulator is rolled up or wound about insulator shaft 104. Thus, as a door curtain descends into a closed position, insulator may be safely stored on insulator shaft 104, and, as a door curtain ascends, insulator may be dispensed or unrolled from shaft 104 to protect the curtain from wear and abrasion.

As described above, however, the circumference of curtain retained about the curtain shaft 102 varies as curtain is rolled and unrolled from shaft 102. Likewise, the circumference of insulator retained about the insulator shaft 104 varies as insulator is rolled and unrolled from shaft 104. Indeed, as the circumference of curtain on shaft 102 decreases (e.g., as the door is closed), the circumference of insulator on shaft 104 increases. And, as the circumference of curtain on shaft 102 increases (e.g., as the door is opened), the circumference of insulator on shaft 104 decreases. Thus, in order to dispense and withdraw insulator at a rate sufficient to match (or substantially match) the rate at which curtain is dispensed and withdrawn from curtain shaft 102, insulator shaft 104 must rotate at a variable rate. For example, and with reference to Table 1 above, as curtain unrolls from shaft 102, insulator shaft 104 must rotate at a decreasing rate. Likewise, as curtain rolls up onto shaft 102, insulator shaft 104 must rotate at an increasing rate.

In simple terms, shafts 102 and 104 may be set into motion or otherwise activated by a drive mechanism. Broadly, a drive mechanism may comprise any type of motor or other propulsion or motivating device capable of turning or imparting rotation to curtain shaft 102 and/or insulator shaft 104. For example, a drive mechanism may comprise a motor.

More particularly, and with further regard to the motion of shafts 102 and 104, a drive mechanism may rotate a drive sprocket 106, which may be coupled to curtain shaft 102. Thus, as a drive mechanism causes drive sprocket 106 to rotate, curtain shaft 102 rotates. Further, as drive sprocket 106 rotates, a drive coupling 204 (e.g., a chain), which may be mechanically coupled to sprocket 106 and recoil assembly sprocket 206, may transfer the motion of sprocket 106 to sprocket 206. Sprocket 206 may be mechanically coupled, through recoil assembly 112 and as described below, to insulator shaft 104. Thus, as a drive mechanism drives sprocket 106, both shafts 102 and 104 may rotate. Drive coupling 204 may be further mechanically coupled to an idler arm assembly 202, which may maintain a tension on drive coupling 204.

In addition, shafts 102 and 104 may be coupled to each other by way of the insulator or a plurality of insulators discussed above. For example, one or more insulators may attach to insulator shaft 102 at strap guide assemblies 108*a*, 108*b*, 108*c*, and/or 108*d*. These insulators may further attach to a door curtain at one or more attachment points (e.g., at or near a portion of a door curtain that attached to curtain shaft 102) and/or to curtain shaft 102 itself (e.g., at one or more strap guide assemblies).

As a result of this interconnection between shafts 102 and 104, insulator may be rolled or unrolled from insulator shaft 104 in various ways. For example, insulator may be drawn or pulled off of insulator shaft 104 by the motion of a door curtain and/or curtain shaft 102. Alternatively, insulator may be dispensed from insulator shaft 104 through the rotation imparted by a drive mechanism, as described above. Likewise, a combination of the foregoing is also feasible.

Insulator shaft 104 may rotate at a variable rate, as required by the differing circumferences of the insulator rolled about shaft 104 and curtain rolled about shaft 102, in response to a compensating motion imparted by recoil assembly 112. That is, recoil assembly 112 may adjust the angular speed of the insulator shaft 104, so that it rotates at a rate sufficient to dispense and withdraw insulator as a door curtain is raised and lowered.

Figures 3A, 3B:
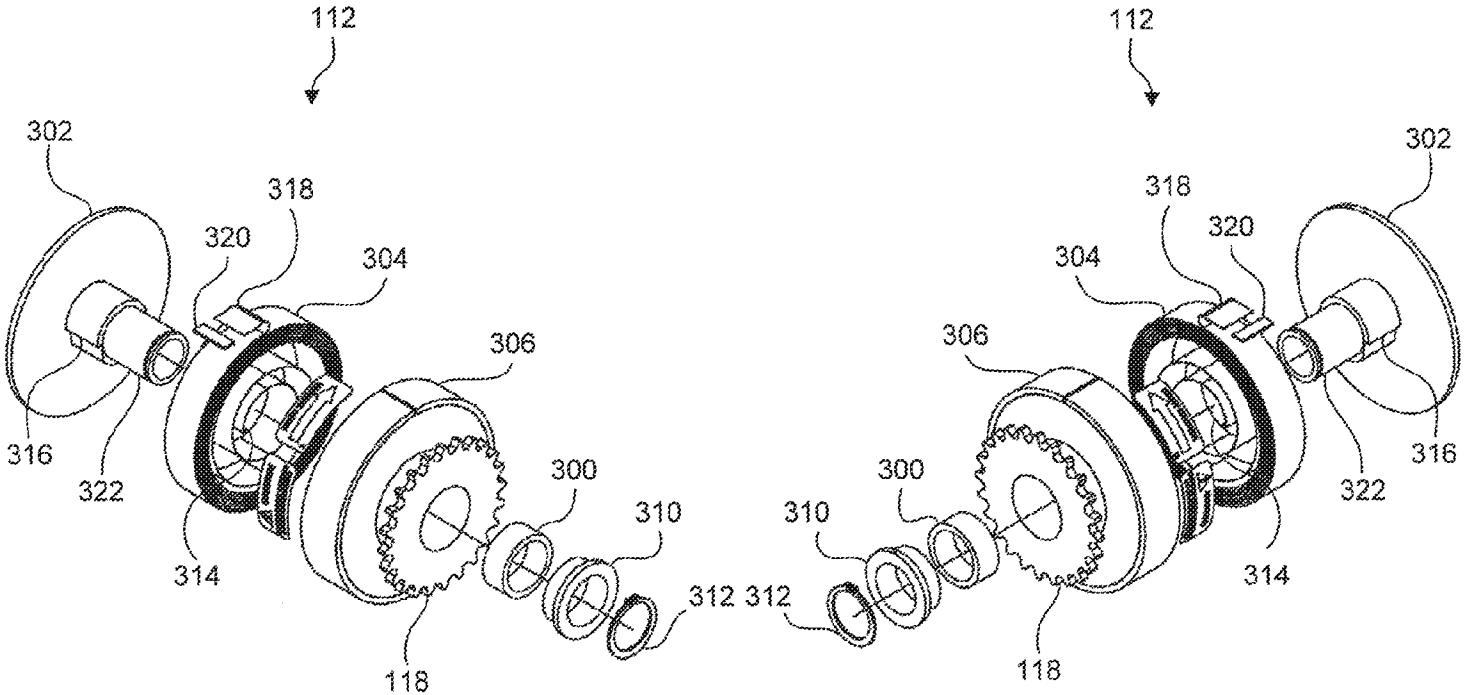
FIG. 3A shows a perspective view of a recoil assembly configured for mounting to the left of a door.
FIG. 3B shows a perspective view of a recoil assembly configured for mounting to the right of a door.

To this end, and with reference now to FIGS. 3A and 3B, recoil assembly 112 may comprise a hub assembly 302, a spring 304, e.g., a "power" or "clock" spring, a sprocket assembly 306, as well as one or more bushings 308 and 310, and/or one or more snap rings 312. Spring 304 may be mounted within and/or coupled to sprocket assembly 306. Spring 304 may be further coupled to hub assembly 302. More particularly, spring 304 may comprise a hook or overbend 314 which may engage a corresponding hook or lip 316 on hub assembly 302. Similarly, spring 304 may comprise an overbend 318, which may engage a corresponding hook or lip on an inner surface of sprocket assembly 306. Overbend 318 and/or overbend 314 may be protected by a covering 320, such as a plastic or nylon plastic.

In an embodiment, overbend 314 may be non-rigidly or non-fixedly mounted to hub assembly 302. Likewise, overbend 318 may be non-rigidly or non-fixedly mounted to sprocket assembly 306. That is, overbend 314 and/or overbend 318 may be free to slide or play, to some extent, on their respective lips. In an embodiment, spring 304 may also be rigidly mounted (i.e., fixed or anchored) to hub assembly 302 and/or sprocket assembly 306. However, a non-rigid mount may extend the useful lifetime of spring 304, and thus the useful lifetime of recoil assembly 112. That is, a non-rigidly mounted spring 304 may operate under less strain or stress than a rigidly mounted spring, particularly at the attachment points of the spring to the hub assembly 302 and sprocket assembly 306 (as these are the points where the spring 304 may encounter the greatest strain). Thus, in an embodiment, recoil assembly 112 may not only operate to protect a door curtain from wear and abrasion; it may also protect a spring 304 from wear. In other words, recoil assembly 112 may extend the useful lifetime of a door curtain and door assembly 100 in two ways: first, by protecting the door curtain, and second, by protecting the spring 304 from wear.

Recoil assembly 112 may be assembled as follows. A central shaft 322 of hub assembly 102 may extend through, and engage with, as described above, a central aperture in spring 304. Shaft 322 may continue through sprocket assembly 306 as well as through a central aperture in sprocket 206. Finally, one or more of bushings 308, 310, and ring 312 may be secured to shaft 322, whereupon spring 304 may, in an embodiment, be enclosed by, and rigidly or non-rigidly mounted within, hub assembly 302 and sprocket assembly 306.

Recoil assembly 112 may be further configured to couple to either or both of a right side of an insulator shaft 104 or a left side of an insulator shaft 104. That is, recoil assembly 112 may be mounted on either the left side of a door or the right said of a door (or both, e.g., if the door is very heavy). Recoil assembly 112 may be thus configured by mounting spring 304 in a forward direction (e.g., if the assembly 112 is to be mounted on a left hand side of a door) as well as a backward or reverse direction (e.g., if the assembly 112 is to be mounted on a right hand side of a door). A left hand configuration is depicted at FIG. 3A, while a right hand configuration is depicted at FIG. 3B.

In operation, recoil assembly 112 may adjust the angular speed of the insulator shaft 104 relative to the angular speed of the curtain shaft 102 as follows. As a door curtain is raised from a closed position to an open position, and as the circumference of door curtain rolled about the curtain shaft 102 requires the insulator shaft to dispense insulator at an angular speed that is greater than the angular speed imparted by recoil assembly sprocket 206, the rotation of curtain shaft 102 may simply pull additional insulator off of insulator shaft 104. As the reader may appreciate, this is possible, as described above, because the insulator shaft 104 may be coupled to the curtain shaft 102 and/or a door curtain. Spring 304 may resist the difference in angular speeds between shaft 102 and shaft 104. However, a drive mechanism may be sufficiently powerful to effect the necessary difference in angular speeds, despite the resistance offered by spring 304. Spring 304 may, as a result of this difference in angular speeds, build tension. This tension building process may continue until a door curtain is fully raised.

In like manner, and as a door curtain is lowered from a raised position into a closed position, spring 304 may adjust the angular speed of the insulator shaft 104 relative to the angular speed of the curtain shaft 102 by imparting a greater angular speed to the insulator shaft 104. More particularly, spring 304 may release the tension that accumulated while the door curtain was being raised, which may, in turn, impart a greater angular speed to the insulator shaft 104. Thus, recoil assembly 112 may, through spring 304, compensate for a required difference in angular speeds between an insulator shaft 104 and a curtain shaft 102.

The tension in spring 304 may be controlled or adjusted, in an embodiment, by adjusting the diameter of recoil assembly sprocket 206. That is, for example, if the diameter of recoil assembly sprocket 206 is equal to one half of the diameter of drive sprocket 106, recoil assembly sprocket 206 will rotate with an angular speed that is approximately twice the angular speed of the drive sprocket 106. Likewise, if the diameter of recoil assembly sprocket 206 is equal to one third of the diameter of drive sprocket 106, recoil assembly sprocket 206 will rotate with an angular speed that is approximately three times greater than the angular speed of the drive sprocket 106. As the recoil assembly sprocket 206 rotates with greater angular speed (relative to the angular speed of the drive sprocket 106), the tension on spring 304 may decrease (i.e., because the insulator shaft 104 is better able to keep up with the requirements of curtain shaft 102). Thus, an optimal diameter of recoil assembly sprocket 206, and/or an ideal relationship between the diameters of each sprocket 106 and 204, may further extend the lifetime of spring 304.

In an embodiment, a door assembly 100 and/or a portion thereof (e.g., a recoil assembly 112, recoil assembly sprocket 206, etc.) may be included in or packaged as part of a kit. In this regard, the kit may be sold as an off the shelf component or package, which an individual may purchase and install. Thus, where one or more of the components described above and with reference to the figures is sold as part of a kit, an individual may purchase the kit and install the components comprising the kit on an existing door frame and/or door curtain.

The detailed description of exemplary embodiments herein makes reference to the accompanying drawings and pictures, which show the exemplary embodiment by way of illustration and its best mode. While these exemplary embodiments are described in sufficient detail to enable those skilled in the art to practice the disclosure, it should be understood that other embodiments may be realized and that logical and mechanical changes may be made without departing from the spirit and scope of the disclosure. Thus, the detailed description herein is presented for purposes of illustration only and not of limitation. Further, any reference to singular includes plural embodiments, and any reference to more than one component may include a singular embodiment.

What is claimed is:

1. A roll-up door comprising:

a truss cage housing;

a curtain shaft installed within the truss cage housing, wherein rotation of the curtain shaft raises and lowers a door curtain along a vertical path;

an insulator shaft installed within the truss cage housing, the insulator shaft disposed aft of and below the curtain shaft; and a drive motor configured to drive the curtain shaft and the insulator shaft, wherein the door curtain is stored on the curtain shaft within the truss cage housing in response to the door curtain being raised to a stowed position, wherein an insulator comprising a woven fabric material is stored on the insulator shaft within the truss cage housing in response to the door curtain being lowered to a deployed position, wherein the insulator is disposed along and between at least two layers of the door curtain when the door curtain is stored on the curtain shaft.

2. The roll up door of claim 1 further comprising a recoil assembly disposed on a side of the truss cage housing.

3. The roll up door of claim 2, wherein the recoil assembly is operatively coupled to the curtain shaft and the insulator shaft and configured to compensate for a difference in angular speed between the curtain shaft and the insulator shaft.

4. The roll up door of claim 2, wherein the recoil assembly comprises:

a recoil assembly sprocket;

a hub assembly that is coupled to the insulator shaft; and a spring that is elastically coupled between the hub assembly and the recoil assembly sprocket.

5. The roll up door of claim 1, wherein the truss cage comprises a hatch that provides access to at least one of the curtain shaft or the insulator shaft.

6. The roll up door of claim 1, wherein the drive motor is mounted to the truss cage.

7. The roll up door of claim 1, wherein the truss cage housing is configured to mount to a frame.

8. The roll up door of claim 7, a wherein the door curtain is deployable from the curtain shaft and out of the truss cage housing to the frame.

9. The roll up door of claim 7, wherein the insulator shaft winds up the insulator within the truss cage housing in response to the door curtain deploying to the frame.

10. A door assembly comprising:

a door housing;

a curtain shaft disposed within the door housing, wherein rotation of the curtain shaft raises and lowers a door curtain along a vertical path; and an insulator shaft disposed within the door housing and located behind the curtain shaft, wherein the door curtain is stored on the curtain shaft within the door housing in response to the door curtain being raised to a stowed position, and wherein an insulator comprising a woven fabric material is stored on the insulator shaft within the door housing in response to the door curtain being lowered to a deployed position, wherein the insulator is disposed along and between at least two layers of the door curtain when the door curtain is stored on the curtain shaft.

11. The door assembly of claim 10, wherein the insulator shaft is disposed below the curtain shaft.

12. The door assembly of claim 10, wherein the door assembly is configured to mount to a frame.

13. The door assembly of claim 10 further comprising a recoil assembly that mounts on the door housing.

14. The door assembly of claim 10, wherein a recoil assembly is operatively coupled to the curtain shaft and the insulator shaft and configured to compensate for a difference in angular speed between the curtain shaft and the insulator shaft.

15. The door assembly of claim 14, wherein the recoil assembly comprises:

a recoil assembly sprocket;

a hub assembly that is coupled to the insulator shaft; and a spring that is elastically coupled between the hub assembly and the recoil assembly sprocket.

* * * * *